US010221043B2

(12) United States Patent
Wesson et al.

(10) Patent No.: US 10,221,043 B2
(45) Date of Patent: Mar. 5, 2019

(54) ELEVATOR SUSPENSION AND/OR DRIVING ARRANGEMENT

(75) Inventors: John P. Wesson, Vernon, CT (US); Gopal R. Krishnan, Wethersfield, CT (US); Huan Zhang, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1345 days.

(21) Appl. No.: 13/996,199

(22) PCT Filed: Dec. 22, 2010

(86) PCT No.: PCT/US2010/061707

§ 371 (c)(1),
(2), (4) Date: Jun. 20, 2013

(87) PCT Pub. No.: WO2012/087304

PCT Pub. Date: Jun. 28, 2012

(65) Prior Publication Data

US 2013/0270044 A1 Oct. 17, 2013

(51) Int. Cl.
*B66B 7/06* (2006.01)
*D07B 1/16* (2006.01)
(Continued)

(52) U.S. Cl.
CPC ..... *B66B 7/062* (2013.01); *B66B 11/008* (2013.01); *B66B 11/08* (2013.01); *D07B 1/16* (2013.01); *Y10T 428/2933* (2015.01)

(58) Field of Classification Search
CPC .... B66B 11/0008; B66B 11/008; B66B 7/062
See application file for complete search history.

(56) References Cited

U.S. PATENT DOCUMENTS 6,295,799 B1 10/2001 Baranda
6,672,046 B1 1/2004 Prewo et al.
(Continued)

FOREIGN PATENT DOCUMENTS

CN 1558865 A 12/2004
CN 1585695 A 2/2005
(Continued)

OTHER PUBLICATIONS

Notification of Reason(s) for Refusal; Korean Patent Office; Appl. No. 10-2013-7019106; dated Nov. 24, 2014; 6 pages.
(Continued)

*Primary Examiner* — Diem M Tran
(74) *Attorney, Agent, or Firm* — Cantor Colburn LLP

(57) ABSTRACT

An elevator system includes an elevator car, one or more sheaves, and one or more belts operably connected to the car and interactive with the one or more sheaves for suspending and/or driving the elevator car. The one or more belts include a plurality of wires arranged into one or more cords, and a jacket substantially retaining the one or more cords. A cord ratio, between a smallest sheave diameter (D) of the one or more sheaves of the elevator system that are interactive with the belt and a largest cord diameter ($d_c$) of the one or more cords, ($D/d_c$) is less than about 55. A wire ratio, between the smallest sheave diameter (D) and the largest wire diameter ($d_w$) of the plurality of wires, ($D/d_w$) is between about 160 and about 315.

55 Claims, 6 Drawing Sheets

(51) Int. Cl.
*B66B 11/00* (2006.01)
*B66B 11/08* (2006.01)

(56) References Cited

U.S. PATENT DOCUMENTS

| | | | | |
|---|---|---|---|---|
| 2003/0206419 | A1* | 11/2003 | Longatti | D04C 1/12 362/551 |
| 2007/0084671 | A1* | 4/2007 | Ach | B66B 7/062 187/261 |
| 2008/0081721 | A1 | 4/2008 | Bissig et al. | |
| 2012/0211310 | A1* | 8/2012 | Peric | B66B 7/062 187/254 |
| 2013/0270044 | A1* | 10/2013 | Wesson | B66B 7/062 187/266 |

FOREIGN PATENT DOCUMENTS

| | | | |
|---|---|---|---|
| EP | 1397304 | A1 | 3/2004 |
| EP | 11511683 | A1 | 3/2005 |
| EP | 2090421 | A1 | 8/2009 |
| JP | 61175072 | A | 8/1986 |
| JP | 2001262482 | A | 9/2001 |
| JP | 2002504469 | A | 2/2002 |
| JP | 2002321882 | A | 11/2002 |
| JP | 2006240819 | A | 9/2006 |
| WO | 0037738 | A1 | 6/2000 |
| WO | 2011128223 | A2 | 10/2011 |

OTHER PUBLICATIONS

Office Action; Intellectual Property Federal Service of Russia; Appl. No. 2013117044/11(025241); dated Oct. 8, 2014; 4 pages.
Search Report; State Intellectual Property Office of People's Republic of China; Appl. No. 201080070853.2; dated Oct. 18, 2014; 2 pages.
Notification of Transmittal of the International Search Report and the Written Opinion of the International Searching Authority, or the Declaration; PCT/US2010/061707; dated Sep. 15, 2011.
European Search Report and Written Opinion; European Application No. 10861020.5; International Filing Date: Dec. 22, 2010; dated Apr. 25, 2017; 10 pages.

* cited by examiner

ELEVATOR SUSPENSION AND/OR DRIVING ARRANGEMENT

BACKGROUND OF THE INVENTION

The subject matter disclosed herein relates to elevator systems. More specifically, the subject disclosure relates to an elevator suspension and/or driving arrangement for such an elevator system.

Elevator systems utilize a lifting means, such as ropes or belts operably connected to an elevator car, and routed over one or more sheaves, also known as pulleys, to propel the elevator along a hoistway. Lifting belts in particular typically include a plurality of wires at least partially within a jacket material. The plurality of wires are often arranged into one or more strands and the strands are then arranged into one or more cords. Wire arrangements are typically designed with at least two basic requirements in mind, breaking strength and cord life. Based on historical data, cord life is relatable to $D/d_c$, where D is a diameter of the smallest sheave over which the cord is routed and $d_c$ is the cord diameter. A $D/d_c$ of at least 40 for lifting means used in suspension or driving applications typically results in a cord which is flexible enough where bending stresses provide acceptable rope life and behavior for safe operation. Current cord constructions for belts used in elevator systems typically utilize a $D/d_c$ above 40, typically between 40 and 50. In addition, the cords are constructed of many fine-diameter wires to meet life requirements. This results in current elevator belts having high manufacturing costs.

BRIEF DESCRIPTION OF THE INVENTION

According to one aspect of the invention, an elevator system comprises an elevator car, one or more sheaves, and one or more belts operably connected to the car and interactive with the one or more sheaves for suspending and/or driving the elevator car. The one or more belts comprise a plurality of wires arranged into one or more cords, and a jacket substantially retaining the one or more cords. A cord ratio, between a smallest sheave diameter (D) of the one or more sheaves of the elevator system that are interactive with the belt and a largest cord diameter ($d_c$) of the one or more cords, ($D/d_c$) is less than about 55. A wire ratio, between the smallest sheave diameter (D) and the largest wire diameter ($d_w$) of the plurality of wires, ($D/d_w$) is between about 160 and about 315.

Alternatively in this or other aspects of the invention, the cord ratio could be between about 38 and about 55, and further alternatively between about 40 and about 48.

Alternatively in this or other aspects of the invention, the wire ratio could be between about 180 and about 300.

Alternatively in this or other aspects of the invention, at least one of the one or more cords could have less than about 49 wires, further alternatively between about 15 and about 38 wires, yet further alternatively between about 18 and about 32 wires.

Alternatively in this or other aspects of the invention, the plurality of wires in the one or more cords could be arranged in a geometrically stable arrangement.

Alternatively in this or other aspects of the invention, the plurality of wires could be formed of drawn steel.

Alternatively in this or other aspects of the invention, at least one wire of the plurality of wires has an ultimate tensile strength of between about 1800 and about 3300 mega Pascals, and further alternatively between about 2200 and about 2700 mega Pascals.

Alternatively in this or other aspects of the invention, at least one of the one or more cords could include a king strand formed from a plurality of wires significantly smaller than the other wires in the cord, and further alternatively the diameters of the wires of the king strand and the other wires in the cord can vary up to approximately +/−12% from a mean diameter.

Alternatively in this or other aspects of the invention, at least one of the one or more cords could include one or more king wires, and further alternatively the diameters of the king wires and the other wires in the cord can vary up to approximately +/−10% from a mean diameter.

According to another aspect of the invention, a belt for suspending and/or driving an elevator car comprises a plurality of wires arranged into one or more cords, and a jacket substantially retaining the one or more cords. A cord-to-wire ratio, between a largest cord diameter ($d_c$) of the one or more cords and the largest wire diameter ($d_w$) of the plurality of wires, ($d_c/d_w$) is between about 4 and about 7.65.

Alternatively in this or other aspects of the invention, the cord-to wire ratio could be between about 4.5 and about 6.25, and further alternatively between about 4.75 and about 5.5.

Alternatively in this or other aspects of the invention, at least one of the one or more cords could comprise less than about 49 wires, further alternatively between about 15 and about 38 wires, and yet further alternatively between about 18 and about 32 wires.

Alternatively in this or other aspects of the invention, at least one wire of the plurality of wires could have an ultimate tensile strength of between about 1800 and about 3300 mega Pascals, and further alternatively between about 2200 and about 2700 mega Pascals.

Alternatively in this or other aspects of the invention, the plurality of wires in the one or more cords could be arranged in a geometrically stable arrangement.

Alternatively in this or other aspects of the invention, the plurality of wires could be formed of drawn steel.

Alternatively in this or other aspects of the invention, at least one of the one or more cords could include a king strand formed from a plurality of wires significantly smaller than the other wires in the cord, and further alternatively the diameters of the wires of the king strand and the other wires in the cord could vary up to approximately +/−12% from a mean diameter.

Alternatively in this or other aspects of the invention, at least one of the one or more cords could include one or more king wires, and further alternatively the diameters of the king wires and the other wires in the cord could vary up to approximately +/−10% from a mean diameter.

According to yet another aspect of the invention, a belt for suspending and/or driving an elevator car comprises a plurality of wires arranged into one or more cords, and a jacket substantially retaining the plurality of wires. The one or more cords each include less than 49 wires. The wires have a wire diameter of less than about 0.68 millimeters, and an ultimate tensile strength of greater than about 1800 mega Pascals.

Alternatively in this or other aspects of the invention, a cord-to-wire ratio, between a largest cord diameter ($d_c$) of the one or more cords and the largest wire diameter ($d_w$) of the plurality of wires, ($d_c/d_w$) could be between about 4 and about 7.65, further alternatively between about 4.5 and about 6.25, further alternatively between about 4.75 and about 5.5.

Alternatively in this or other aspects of the invention, the one or more cords could have between about 15 to about 38 wires, further alternatively between about 18 and about 32 wires.

Alternatively in this or other aspects of the invention, at least one of the plurality of wires could have an ultimate tensile strength of between about 1800 and about 3300 mega Pascals, and further alternatively between about 2200 and about 2700 mega Pascals.

Alternatively in this or other aspects of the invention, the plurality of wires in the one or more cords could be arranged in a geometrically stable arrangement.

Alternatively in this or other aspects of the invention, the plurality of wires could be formed of drawn steel.

Alternatively in this or other aspects of the invention, at least one of the one or more cords could include a king strand formed from a plurality of wires significantly smaller than the other wires in the cord, and further alternatively the diameters of the wires of the king strand and the other wires in the cord can vary up to approximately +/−12% from a mean diameter.

Alternatively in this or other aspects of the invention, at least one of the one or more cords includes one or more king wires, and further alternatively the diameters of the king wires and the other wires in the cord can vary up to approximately +/−10% from a mean diameter.

According to still another aspect of the invention, a method of constructing one or more belts for suspending and/or driving a car and/or counterweight of an elevator system comprises: determining a smallest sheave diameter (D) of one or more sheaves in the elevator system that interact with the one or more belts, selecting a plurality of wires such that a wire ratio, between the smallest sheave diameter (D) and a largest wire diameter ($d_w$) of the plurality of wires, ($D/d_c$) is between about 160 and about 315, arranging the plurality of wires into one or more cords such that a cord ratio, between the smallest sheave diameter (D) and a largest cord diameter ($d_c$) of the one or more cords, ($D/d_c$) is less than about 55; and substantially retaining the one or more cords with a jacket.

Alternatively in this or other aspects of the invention, the wire arranging step could use less than about 49 wires per cord, further alternatively between about 15 and about 38 wires per cord, yet further alternatively between about 18 and about 32 wires per cord.

Alternatively in this or other aspects of the invention, the wire selecting step could produce a wire ratio ($D/d_w$) of between about 180 and about 300.

Alternatively in this or other aspects of the invention, the wire arranging step can produce a cord ratio ($D/d_c$) of between about 40 and about 48.

Alternatively in this or other aspects of the invention, the wire arranging step could include arranging the wires in a geometrically stable arrangement.

Alternatively in this or other aspects of the invention, the wire selecting step could include using wires formed of drawn steel.

Alternatively in this or other aspects of the invention, the wire arranging step could include using a king strand formed from a plurality of king wires significantly smaller than the other wires in the cord, and further alternatively the wire selecting step could include selecting diameters of the king strand and the other wires in the cord that can vary up to approximately +/−12% from a mean diameter.

Alternatively in this or other aspects of the invention, the wire arranging step includes using one or more king wires, and further alternatively the wire selecting step includes selecting diameters of the king wires and the other wires in the cord that can vary up to approximately +/−10% from a mean diameter.

The detailed description explains the invention, together with advantages and features, by way of examples with reference to the drawings.

DETAILED DESCRIPTION OF THE INVENTION

Figure 1A:
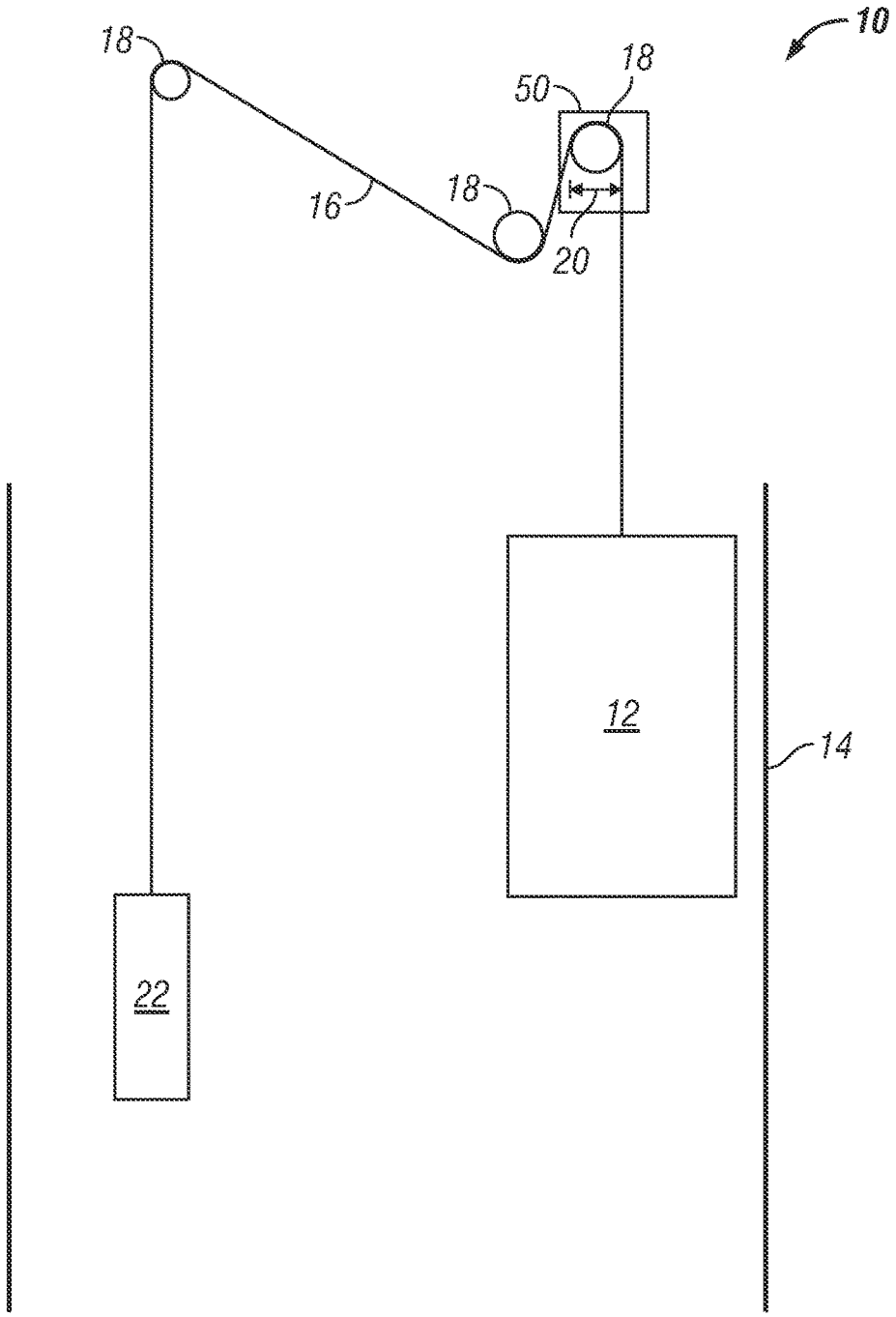
FIG. 1A is a schematic view of an exemplary elevator system.
Figure 1B:
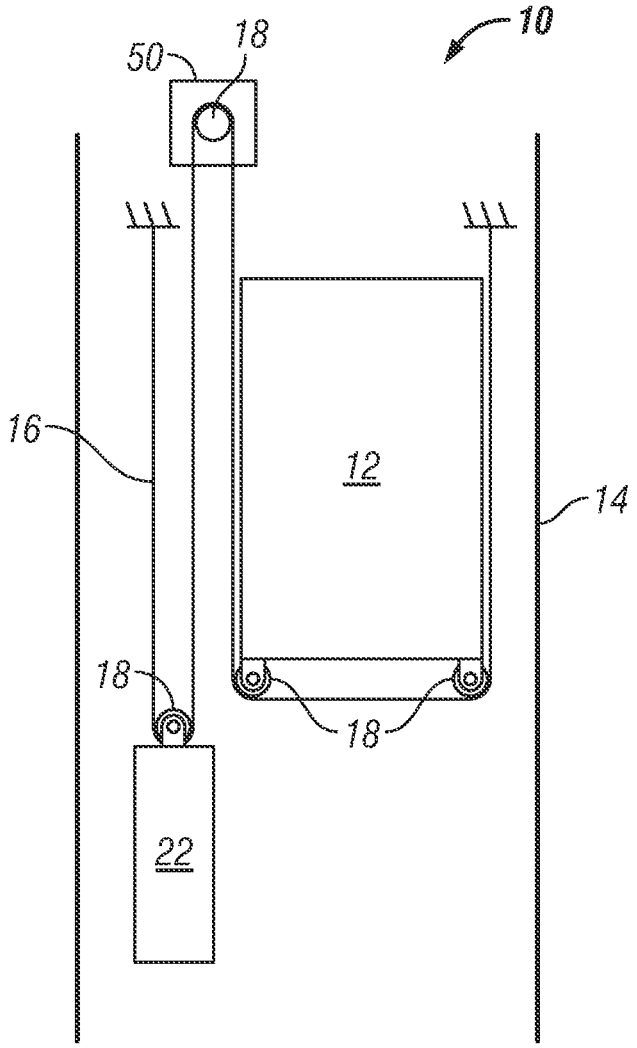
FIG. 1B is a schematic view of another exemplary elevator system.
Figure 1C:
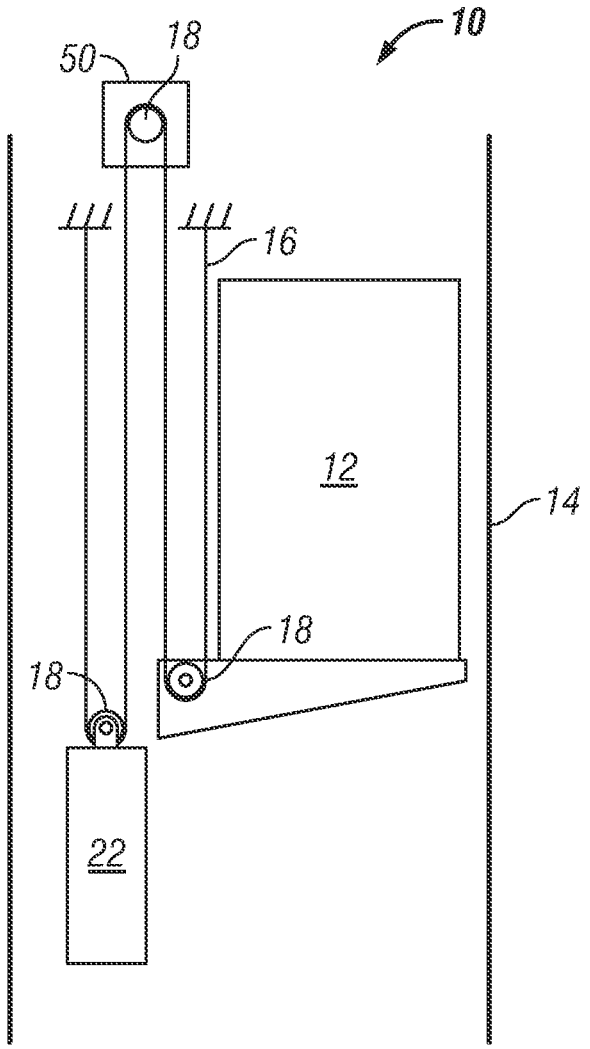
FIG. 1C is a schematic view of still another exemplary elevator system.

Shown in FIGS. 1A, 1B and 1C are schematics of exemplary traction elevator systems 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and maintain belt tension on both sides of the traction sheave during operation.

The sheaves 18 each have a diameter 20, which may be the same or different than the diameters of the other sheaves 18 in the elevator system 10. At least one of the sheaves 18 could be a drive sheave. A drive sheave is driven by a machine 50. Movement of drive sheave by the machine 50 drives, moves and/or propels (through traction) the one or more belts 16 that are routed around the drive sheave.

At least one of the sheaves 18 could be a diverter, deflector or idler sheave. Diverter, deflector or idler sheaves are not driven by a machine 50, but help guide the one or more belts 16 around the various components of the elevator system 10.

The smallest sheave diameter 20 of the elevator system 10 could be in the range of about 40 to about 180 millimeters. Alternatively, the smallest sheave diameter 20 of the elevator system 10 could be in the range of about 50 to about 150 millimeters. Further alternatively, the smallest sheave diameter 20 could be in the range of about 50 to about 135 millimeters.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 (such as shown in the exemplary elevator systems in FIG.

1A, 1B or 1C) or only one side of the one or more belts 16 engages the one or more sheaves 18.

FIG. 1A provides a 1:1 roping arrangement in which the one or more belts 16 terminate at the car 12 and counterweight 22. FIGS. 1B and 1C provide different roping arrangements. Specifically, FIGS. 1B and 1C show that the car 12 and/or the counterweight 22 can have one or more sheaves 18 thereon engaging the one or more belts 16 and the one or more belts 16 can terminate elsewhere, typically at a structure within the hoistway 14 (such as for a machineroomless elevator system) or within the machine room (for elevator systems utilizing a machine room. The number of sheaves 18 used in the arrangement determines the specific roping ratio (e.g. the 2:1 roping ratio shown in FIGS. 1B and 1C or a different ratio). FIG. 1C also provides a so-called rucksack or cantilevered type elevator. The present invention could be used on elevators systems other than the exemplary types shown in FIGS. 1A, 1B and 1C.

Figure 2:
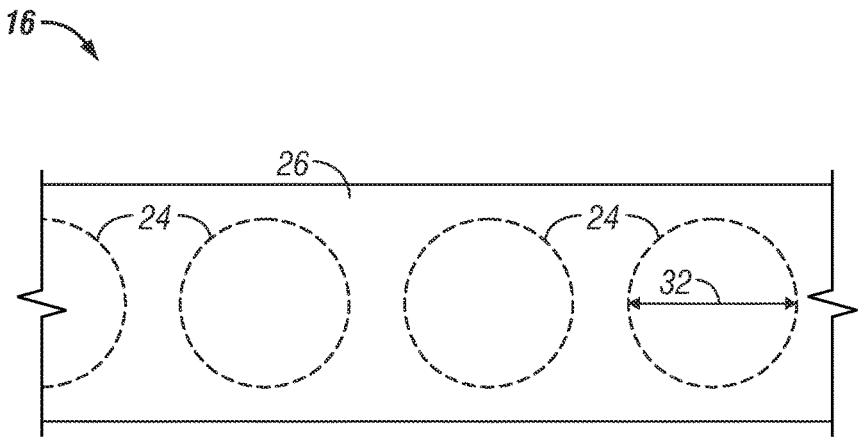
FIG. 2 is a cross-sectional schematic view of an exemplary belt for an elevator system.

FIG. 2 provides a schematic of an exemplary belt construction or design. Each belt 16 is constructed of one or more cords 24 in a jacket 26. The cords 24 of the belt 16 could all be identical, or some or all of the cords 24 used in the belt 16 could be different than the other cords 24. For example, one or more of the cords 24 could have a different construction or size than the other cords 24. As seen in FIG. 2, the belt 16 has an aspect ratio greater than one (i.e. belt width is greater than belt thickness).

The belts 16 are constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 12.

The jacket 26 could be any suitable material, including a single material, multiple materials, two or more layers using the same or dissimilar materials, and/or a film. In one arrangement, the jacket 26 could be a polymer, such as an elastomer, applied to the cords 24 using, for example, an extrusion or a mold wheel process. In another arrangement, the jacket 26 could be a woven fabric that engages and/or integrates the cords 24. As an additional arrangement, the jacket 26 could be one or more of the previously mentioned alternatives in combination.

The jacket 26 can substantially retain the cords 24 therein. The phrase substantially retain means that the jacket 26 has sufficient engagement with the cords 24 such that the cords 24 do not pull out of, detach from, and/or cut through the jacket 26 during the application on the belt 16 of a load that can be encountered during use in an elevator system 10 with, potentially, an additional factor of safety. In other words, the cords 24 remain at their original positions relative to the jacket 26 during use in an elevator system 10. The jacket 26 could completely envelop the cords 24 (such as shown in FIG. 2), substantially envelop the cords 24, or at least partially envelop the cords 24

Each cord 24 comprises a plurality of wires 28 in a geometrically stable arrangement. Optionally, some or all of these wires 28 could be formed into strands 30, which are then formed into the cord 24. The phrase geometrically stable arrangement means that the wires 28 (and if used, strands 30) generally remain at their theoretical positions in the cord 24. In other words, movement of the wires 28 (and if used, strands 30) is limited. For example, movement of wire 28 could be limited to less than approximately thirty percent (30%) of its diameter. Movement of strand 30 could be limited to less than approximately five percent (5%) of its diameter.

Each cord 24 (and if used, each strand 30 in the cord 24) also includes a core which supports the wires 28 and/or strands 30. The core could be load bearing or non-load bearing in the tensile direction. The core could be made from any suitable material, such as a metal (e.g. steel) or a non-metal (e.g. natural or synthetic fiber).

Some possible cord constructions will now be described. In one possible construction of cord 24, at least some of the wires 28 are first formed into one or more strands 30 (with each strand 30 being constructed identically or differently to one or more of the other strands 30). These one or more strands 30 are then formed (possibly with one or more additional wires 28) to form the cord 24. The cords in FIGS. 5 and 6 (described in greater detail below) provide examples of this type of cord construction.

In another possible construction of cord 24, the wires 28 are directly formed into the cord 24. In other words, this construction does not utilize strands 30. The cords in FIGS. 3 and 4 (described in greater detail below) provide several examples of this type of cord construction.

Regardless of the construction used, twisting together of the wires 28 and/or strands 26 during construction can contribute to the aforementioned geometric stability to the cords 24 and provide other benefits to the cord 24. The manner (and variation) of twisting has various possibilities. For example, a strand 26 or cord 24 having multiple rings of wires 28 could have the wires 28 in each of the multiple rings twisted in the same direction (referred to as a parallel lay) or have the wires 28 in one of the multiple rings twist in the opposite direction than the wire 28 in another of the multiple rings (referred to as a cross lay). Also, a cord 24 having multiple strands 26 could use strands 26 having the same twist/lay or a different twist/lay. In addition to the possible lays within a cord 24, the belt 16 could include multiple cords 24 that are twisted differently. For example, the belt 16 could have one or more cords 24 with wires 28 and/or strands 26 in a right hand lay and one or more cords 24 with wires 28 and/or strands in a left hand lay. Additionally, the winding or closing operation could occur in a single step or occur in sequential steps. The present invention can utilize any or all of these cord constructions.

The wires 28 used in the cords 24 could be made of any suitable material that enables the cords 24 to meet the requirements of the elevator system 10. For example, the wires 28 could be formed of drawn steel. Further, the wires 28 may be additionally coated with a material that is dissimilar to the base material, to reduce or prevent corrosion, wear, and/or fretting or the like (such as zinc, brass, or a nonmetallic material), and/or to promote retention and/or interaction between the jacket material and the cord surface (such as an organic adhesive, an epoxy, or a polyurethane).

One or more of the wires 28 used in the cords 24 may have an ultimate tensile strength of about 1800 to about 3300 mega Pascals (MPa). Alternatively, the ultimate tensile strength may be about 2200 to about 3000 MPa. Further alternatively, the ultimate tensile strength may be about 2200 to about 2700 MPa.

One or more of the cords 24 in the belt 16 could be constructed with less than forty-nine wires 28. Alternatively, the cord 24 could have in the range of between about fifteen and about thirty-eight wires 28. Further alternatively, the cord 24 could have in the range of between about eighteen and about thirty-two wires 28. Even further alternatively, the cord 24 could have in the range of between about twenty and about twenty-seven wires 28. Additionally or alternatively, the wires 28 used in the cord 24 can have a diameter of less than about 0.68 mm.

Figure 3:
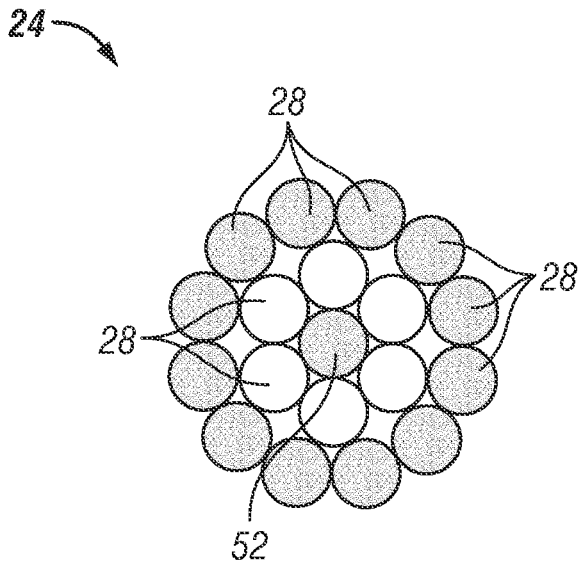
FIG. 3 is a cross-sectional view of an exemplary cord construction.

The exemplary cord 24 of FIG. 3 includes a load bearing core (specifically a single king wire 52) surrounded by six wires 28 surrounded by twelve wires 28. This is referred to as a 1+6+12 arrangement. Due to the construction of the cord 24 (e.g. using different lay lengths and/or opposite twisting of the inner and outer rings of wires), none of the twelve wires 28 in the outer ring of wires move into a position within the inner ring of six wires 28.

Figure 4:
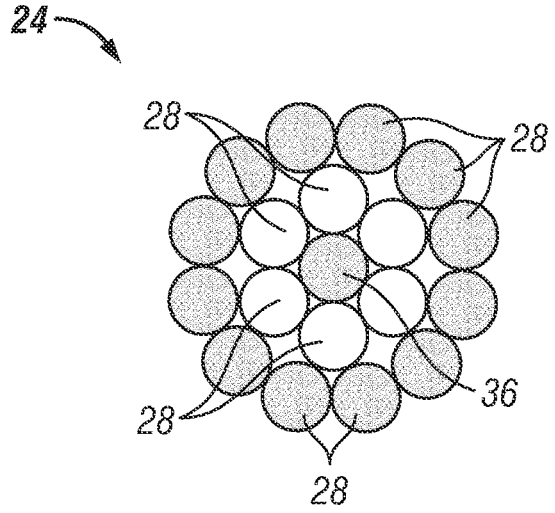
FIG. 4 is a cross-sectional view of another exemplary cord construction.

The exemplary cord 24 of FIG. 4 has the same 1+6+12 arrangement as the exemplary cord 24 of FIG. 3, except that this core is non-load bearing. The core can be a non-metallic core element 36. Similar to the previous example, the construction of this cord 24 (e.g. using different lay lengths and/or opposite twisting of the inner and outer rings of wires) results in none of the twelve wires 28 in the outer ring of wires move into a position within the inner ring of six wires 28.

Figure 5:
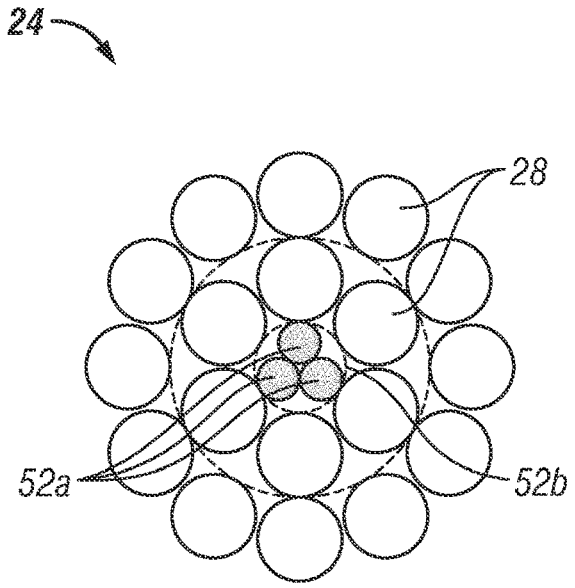
FIG. 5 is a cross-sectional view of still another exemplary cord construction.

The exemplary cord 24 of FIG. 5 is similar to the exemplary cord 24 of FIG. 3, except that the load bearing core (which was a king wire 52 in FIG. 3) now comprises three king wires 52*a* that are smaller than the remaining wires 28 used in the cord formed into a king strand 52. This is referred to as a 3+6+12 arrangement. Similar to the previous example, the construction of this cord 24 (e.g. using different lay lengths and/or opposite twisting of the inner and outer rings of wires) results in none of the wires 28 in the outer rings of wires moving into a position within an inner ring of wires 28.

Figure 6:
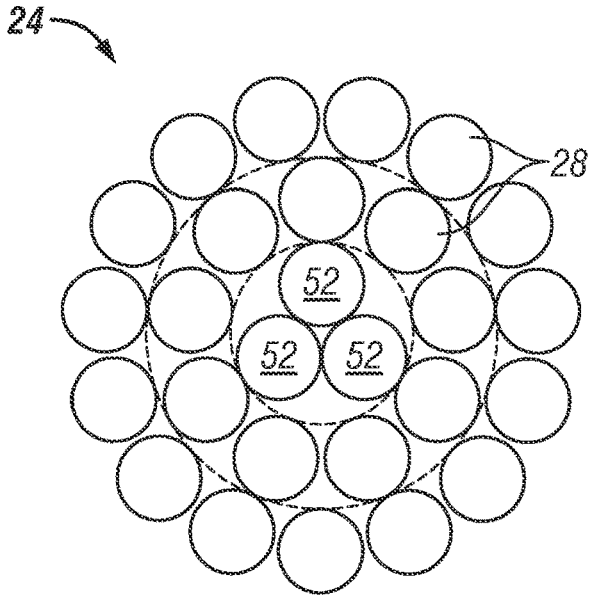
FIG. 6 is a cross-sectional view of yet another exemplary cord construction.

The exemplary cord of FIG. 6 includes a load bearing core (specifically king three wires 52) surrounded by nine wires 28 surrounded by fifteen wires 28. This is referred to as a 3+9+15 arrangement. Similar to the previous example, the construction of this cord 24 (e.g. using different lay lengths and/or opposite twisting of the inner and outer rings of wires) results in none of the wires 28 in the outer rings of wires moving into a position within an inner ring of wires 28.

The elements forming the cord 24 can all have the same diameter, or some or all of the elements forming the cord 24 could have different diameters than the other elements forming the cord 24. In one alternative, the wires 28 and (if using one or more metallic cores) either the king wire(s) 52 or the king strand 52*b* have similar diameters (though not necessarily identical diameters). Whether the king wire(s) 52 or the king strand 52*b* are considered depends on the specific cord construction.

If a metallic core comprises multiple wires and these wires are significantly smaller (e.g. about 50% or smaller in diameter) than the other wires 28 in the cord, then the diameter of the king strand 52*b* (i.e. the effective combined diameter of the multiple king wires 52*a* forming the king strand 52*b*) is used. In this situation, the phrase similar diameters means that the diameter of each wire (including the king strand 52*b* and the remaining wires 28 of the cord 24) can vary up to approximately +/−12% from the mean diameter of these elements.

In all other situations with a metallic core, the diameter(s) of the king wire(s) 52 is used. In these situations, the phrase similar diameters means that the diameter of each wire (including the king wire(s) 52 and the remaining wires 28 in the cord 24) can vary up to approximately +/−10% from the mean diameter of these elements.

If a core is non-metallic, then its diameter is disregarded when determining whether the wires have similar diameters.

The present invention utilizes several ratios for the sizing of the wires 28, cords 24 and/or sheaves 18, for example to meet operational requirements of the elevator system 10. The first ratio is referred to as cord ratio. The first ratio is $D/d_c$, where D is a sheave diameter 20 of the smallest sheave(s) 18 over which the belt 16 is routed, and $d_c$ is a cord diameter 32 of the largest cord(s) 24 in the belt 16. The first ratio can be less than about 55. Alternatively, the first ratio can be in the range of about 38 to about 55. Further alternatively, the first ratio can be in the range of about 40 to about 48.

The second ratio is referred to as wire ratio. The second ratio is $D/d_w$, where $d_w$ is a diameter of the largest wire(s) 28 in the cord 24. The second ratio can be in the range of about 160 to about 315. Alternatively, the second ratio can be in the range of about 180 to about 300. Further alternatively, the second ratio can be in the range of about 200 to about 270.

The present invention could be additionally or alternatively described in terms of a third ratio, which can be derived from the first ratio and the second ratio, that is referred to as cord-to-wire ratio. The third ratio is $d_c/d_w$. The third ratio can be in the range of about 4.0 to about 7.65. Alternatively, the third ratio could be in the range of about 4.5 to about 6.25. Further alternatively, the third ratio could be in the range of about 4.75 to about 5.5.

For clarity, sheave diameter is the effective diameter of the sheave (and not necessarily the actual diameter of the sheave). Effective sheave diameter is measured at the position of the cord 24 when the belt 16 engages the sheave 18 during use of the elevator system 10.

Also for clarity, the diameter of the wire, strand and/or cord is determined by measuring the diameter of the circumscribing circle. In other words, the diameter of the wire, strand and/or cord diameter is the largest cross-sectional dimension of that element.

If the exemplary cord construction of FIG. 3 used wires (including the king wire 28 and the remaining wires 28 in the cord 24) with a diameter of 0.35 mm, the result would be a cord 24 with a diameter of 1.75 mm. If this cord 24 was used in a belt 16 in an elevator system 10 with one or more sheaves 18 (and the smallest diameter of these sheaves was 77 mm), the ratios would be:

First ratio$=D/d_c=77/1.75=44$

Second ratio$=D/d_w=77/0.35=220$

Third ratio$=d_c/d_w=1.75/0.35=5$

If the exemplary cord construction of FIG. 4 used wires 28 with a diameter of 0.35 mm and non-load bearing core 36 with a diameter of 0.38 mm, the result would be a cord 24 with a diameter of 1.75 mm. Since the core is non-metallic, its diameter is not considered in the various ratios. If this cord 24 was used in a belt 16 in an elevator system 10 with one or more sheaves 18 (and the smallest diameter of these sheaves was 77 mm), the ratios would be:

First ratio$=D/d_c=77/1.75=44$

Second ratio$=D/d_w=77/0.35=220$

Third ratio$=d_c/d_w=1.75/0.35=5$

If the exemplary cord construction of FIG. 5 used king wires 52 with a diameter of 0.175 mm and the remaining wires 28 with a diameter of 0.35 mm, the result would be a cord 24 with a diameter of 1.75 mm. As discussed above, the diameter of the king strand (and not the individual king wires 52) would be used since the king wires 52 are significantly smaller than the remaining wires 28 in the cord 24. This results in the king strand (0.38 mm) having the largest wire diameter in the cord 24. If this cord was used in a belt 16 in an elevator system 10 with one or more sheaves 18 (and the smallest diameter of these sheaves 18 was 77 mm), the ratios would be:

First ratio=$D/d_c$=77/1.75=44

Second ratio=$D/d_w$=77/0.38=203

Third ratio=$d_c/d_w$=1.75/0.38=4.6

If the exemplary cord construction of FIG. 6 used wires (including the king wires 52 and the remaining wires 28 in the cord 24) with a diameter of 0.305 mm, the result would be a cord 24 with a diameter of 1.89 mm. If this cord 24 was used in a belt 16 in an elevator system 10 with one or more sheaves 18 (and the smallest diameter of these sheaves 18 was 77 mm), the ratios would be:

First ratio=$D/d_c$=77/1.89=41

Second ratio=$D/d_w$=77/0.305=252

Third ratio=$d_c/d_w$=1.89/0.305=6.20

In the foregoing description, the various references to wire(s), features of the wire(s) and ratios do not apply to filler wires that may be used in a cord construction. Filler wires generally are smaller wires that carry little, if any, of the tensile load of the cord (e.g. each carry less than about 15% of the mean individual tensile load of the primary wires).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An elevator system comprising:

an elevator car;

one or more sheaves; and one or more belts operably connected to the car and interactive with the one or more sheaves for suspending or driving the elevator car, a belt of the one or more belts comprising a plurality of wires arranged into a plurality of cords, the cords arrayed laterally across a width of the belt, and a jacket substantially retaining the one or more cords, wherein:

a cord ratio, between a smallest sheave diameter (D) of the one or more sheaves of the elevator system that are interactive with the belt and a largest cord diameter (dc) of the plurality of cords, (D/dc) is less than about 55; and a wire ratio, between the smallest sheave diameter (D) and the largest wire diameter (dw) of the plurality of wires, (D/dw) is between 180 and 300.

2. The elevator system of claim 1, wherein the cord ratio is between about 38 and about 55.

3. The elevator system of claim 2, wherein the cord ratio is between about 40 and about 48.

4. The elevator system of claim 1, wherein at least one of the one or more cords has less than about 49 wires.

5. The elevator system of claim 1, wherein at least one of the one or more cords has between about 15 and about 38 wires.

6. The elevator system of claim 1, wherein at least one of the one or more cords has between about 18 and about 32 wires.

7. The elevator system of claim 1, wherein the plurality of wires in the one or more cords are arranged in a geometrically stable arrangement.

8. The elevator system of claim 1, wherein the plurality of wires are formed of drawn steel.

9. The elevator system of claim 1, wherein at least one wire of the plurality of wires has an ultimate tensile strength of between about 1800 and about 3300 mega Pascals.

10. The elevator system of claim 1, wherein at least one wire of the plurality of wires has an ultimate tensile strength of between about 2200 and about 2700 mega Pascals.

11. The elevator system of claim 1, wherein at least one of the one or more cords includes a king strand formed from a plurality of king wires significantly smaller than the other wires in the cord.

12. The elevator system of claim 11, wherein the diameters of the wires of the king strand and the other wires in the cord can vary up to approximately +/−12% from a mean diameter.

13. The elevator system of claim 1, wherein at least one of the one or more cords includes one or more king wires.

14. The elevator system of claim 13, wherein the diameters of the king wires and the other wires in the cord can vary up to approximately +/−10% from a mean diameter.

15. A belt for suspending or driving an elevator car, comprising:

a plurality of wires arranged into a plurality of cords, the cords arrayed laterally across a width of the belt; and a jacket substantially retaining the plurality of cords;

wherein a cord-to-wire ratio, between a largest cord diameter (dc) of a cord of the plurality of cords and the largest wire diameter (dw) of the plurality of wires, (dc/dw) is between about 4 and about 7.65; and a wire ratio, between a smallest sheave diameter (D) and the largest wire diameter (dw) of the plurality of wires, (D/dw) is between 180 and 300.

16. The belt of claim 15, wherein the cord-to wire ratio is between about 4.5 and about 6.25.

17. The belt of claim 16, wherein the cord-to-wire ratio is between about 4.75 and about 5.5.

18. The belt of claim 15, wherein at least one of the one or more cords comprises less than about 49 wires.

19. The belt of claim 15, wherein at least one of the one or more cords comprises between about 15 and about 38 wires.

20. The belt of claim 15, wherein at least one of the one or more cords comprises between about 18 and about 32 wires.

21. The belt of claim 15, wherein at least one wire of the plurality of wires has an ultimate tensile strength of between about 1800 and about 3300 mega Pascals.

22. The belt of claim 15, wherein at least one wire of the plurality of wires has an ultimate tensile strength of between about 2200 and about 2700 mega Pascals.

23. The belt of claim 15, wherein the plurality of wires in the one or more cords are arranged in a geometrically stable arrangement.

24. The belt of claim 15, wherein the plurality of wires are formed of drawn steel.

25. The belt of claim 15, wherein at least one of the one or more cords includes a king strand formed from a plurality of king wires significantly smaller than the other wires in the cord.

26. The belt of claim 25, wherein the diameters of the wires of the king strand and the other wires in the cord can vary up to approximately +/−12% from a mean diameter.

27. The belt of claim 15, wherein at least one of the one or more cords includes one or more king wires.

28. The belt of claim 27, wherein the diameters of the king wires and the other wires in the cord can vary up to approximately +/−10% from a mean diameter.

29. A belt for suspending or driving an elevator car, comprising:

a plurality of wires arranged into a plurality of cords, the plurality of cords arranged laterally across a width of the belt; and a jacket substantially retaining the plurality of cords;

wherein:

the plurality of cords each include less than 49 wires;

a wire ratio, between a smallest sheave diameter (D) and the largest wire diameter (dw) of the plurality of wires, (D/dw) is between 180 and 300;

and the plurality of wires:

have a wire diameter of less than about 0.68 millimeters; and have an ultimate tensile strength of greater than about 1800 mega Pascals.

30. The belt of claim 29, wherein a cord-to-wire ratio, between a largest cord diameter (dc) of the one or more cords and the largest wire diameter (dw) of the plurality of wires, (dc/dw) is between about 4 and about 7.65.

31. The belt of claim 30, wherein the cord-to wire ratio (dc/dw) is between about 4.5 and about 6.25.

32. The belt of claim 31, wherein the cord-to-wire ratio (dc/dw) is between about 4.75 and about 5.5.

33. The belt of claim 29, wherein the plurality of wires is between about 15 and about 38 wires.

34. The belt of claim 29, wherein the plurality of wires is between about 18 and about 32 wires.

35. The belt of claim 29, wherein at least one of the plurality of wires has an ultimate tensile strength of between about 1800 to about 3300 mega Pascals.

36. The belt of claim 29, wherein the ultimate tensile strength is between about 2200 and about 2700 mega Pascals.

37. The belt of claim 29, wherein the plurality of wires in the one or more cords are arranged in a geometrically stable arrangement.

38. The belt of claim 29, wherein the plurality of wires are formed of drawn steel.

39. The belt of claim 29, wherein at least one of the one or more cords includes a king strand formed from a plurality of king wires significantly smaller than the other wires in the cord.

40. The belt of claim 39, wherein the diameters of the wires of the king strand and the other wires in the cord can vary up to approximately +/−12% from a mean diameter.

41. The belt of claim 29, wherein at least one of the one or more cords includes one or more king wires.

42. The elevator system of claim 41, wherein the diameters of the king wires and the other wires in the cord can vary up to approximately +/−10% from a mean diameter.

43. A method of constructing one or more belts for suspending or driving a car or counterweight of an elevator system comprising:

determining a smallest sheave diameter (D) of one or more sheaves in the elevator system that interact with the one or more belts;

selecting a plurality of wires such that a wire ratio, between the smallest sheave diameter (D) and a largest wire diameter (dw) of the plurality of wires, (D/dw) is between 180 and 300;

arranging the plurality of wires into a plurality of cords such that a cord ratio, between the smallest sheave diameter (D) and a largest cord diameter (dc) of the one or more cords, (D/dc) is less than about 55;

arranging the plurality of cords laterally across a width of the belt; and substantially retaining the plurality of cords with a jacket.

44. The method of claim 43, wherein the wire arranging step uses less than about 49 wires per cord.

45. The method of claim 43, wherein the wire arranging step uses between about 15 and about 38 wires per cord.

46. The method of claim 43, wherein the wire arranging step uses between about 18 and about 32 wires per cord.

47. The method of claim 43, wherein the wire selecting step produces a wire ratio (D/dw) of between about 180 and about 300.

48. The method of claim 43, wherein the wire arranging step produces a cord ratio (D/dc) of between about 38 and about 55.

49. The method of claim 43, wherein the wire arranging step produces a cord ratio (D/dc) of between about 40 and about 48.

50. The method of claim 43, wherein the wire arranging step includes arranging the wires in a geometrically stable arrangement.

51. The method of claim 43, wherein the wire selecting step includes using wires formed of drawn steel.

52. The method of claim 43, wherein the wire arranging step includes using a king strand formed from a plurality of king wires significantly smaller than the other wires in the cord.

53. The method of claim 52, wherein the wire selecting step includes selecting diameters of the king strand and the other wires in the cord that can vary up to approximately +/−12% from a mean diameter.

54. The method of claim 43, wherein the wire arranging step includes using one or more king wires.

55. The method of claim 54, wherein the wire selecting step includes selecting diameters of the king wires and the other wires in the cord that can vary up to approximately +/−10% from a mean diameter.

* * * * *